US006812903B1

(12) United States Patent
Sievenpiper et al.

(10) Patent No.: US 6,812,903 B1
(45) Date of Patent: Nov. 2, 2004

(54) RADIO FREQUENCY APERTURE

(75) Inventors: Daniel Sievenpiper, Los Angeles, CA (US); Robin Harvey, Newbury Park, CA (US)

(73) Assignee: HRL Laboratories, LLC, Malibu, CA (US)

( * ) Notice: Subject to any disclaimer, the term of this patent is extended or adjusted under 35 U.S.C. 154(b) by 0 days.

(21) Appl. No.: 09/525,255

(22) Filed: Mar. 14, 2000

(51) Int. Cl.[7] ..... H01Q 15/10
(52) U.S. Cl. ..... 343/753; 343/754; 343/909
(58) Field of Search ..... 343/753–754, 343/909

(56) References Cited

U.S. PATENT DOCUMENTS

| | | | | |
|---|---|---|---|---|
| 2,763,860 A | * | 9/1956 | Ortusi et al. | 343/909 |
| 3,267,480 A | | 8/1966 | Lerner | 343/911 |
| 3,810,183 A | | 5/1974 | Krutsinger et al. | 343/708 |
| 3,961,333 A | * | 6/1976 | Purinton | 343/909 |
| 4,169,268 A | * | 9/1979 | Schell et al. | 343/909 |
| 4,228,437 A | * | 10/1980 | Shelton | 343/909 |
| 4,266,203 A | | 5/1981 | Saudreau et al. | 333/21 |
| 4,387,377 A | * | 6/1983 | Kandler | 343/909 |
| 4,594,595 A | | 6/1986 | Struckman | 343/770 |
| 4,749,996 A | | 6/1988 | Tresselt | 343/700 |
| 4,782,346 A | | 11/1988 | Sharma | 343/795 |
| 4,843,400 A | | 6/1989 | Tsao et al. | 343/700 |
| 4,843,403 A | | 6/1989 | Lalezari et al. | 343/767 |
| 4,853,704 A | | 8/1989 | Diaz et al. | 343/767 |
| 4,905,014 A | | 2/1990 | Gonzalez et al. | 343/909 |
| 5,021,795 A | | 6/1991 | Masiulis | 343/700 |
| 5,023,623 A | | 6/1991 | Kreinheder et al. | 343/725 |
| 5,081,466 A | | 1/1992 | Bitter, Jr. | 343/767 |
| 5,115,217 A | | 5/1992 | McGrath et al. | 333/246 |
| 5,146,235 A | | 9/1992 | Frese | 343/895 |
| 5,158,611 A | | 10/1992 | Ura et al. | 106/499 |
| 5,268,701 A | | 12/1993 | Smith | 343/767 |

(List continued on next page.)

FOREIGN PATENT DOCUMENTS

| | | |
|---|---|---|
| DE | 196 00 609 A1 | 4/1997 |
| EP | 0 539 297 | 4/1993 |
| FR | 2 785 476 | 5/2000 |
| GB | 2 281 662 | 3/1995 |
| GB | 2 328 748 | 3/1999 |
| WO | 94/00891 | 1/1994 |
| WO | 96/29621 | 9/1996 |
| WO | WO 98/21734 | 5/1998 |
| WO | WO 99/50929 | 10/1999 |
| WO | WO 00/44012 | 7/2000 |

OTHER PUBLICATIONS

Balanis, C., "Aperture Antennas", *Antenna Theory, Analysis and Design*, 2nd Edition, (New York, John Wiley & Sons, 1997), Chap. 12, pp. 575–597.

Balanis, C., "Microstrip Antennas", *Antenna Theory, Analysis and Design*, 2nd Edition, (New York, John Wiley & Sons, 1997) , Chap. 14, pp. 722–736.

Cognard, J., "Alignment of Nematic Liquid Crystals and Their Mixtures" *Mol. Cryst. Liq. Cryst.* Suppl. 1, 1 (1982)pp. 1–74.

(List continued on next page.)

*Primary Examiner*—Michael C. Wimer
(74) *Attorney, Agent, or Firm*—Ladas & Parry

(57) ABSTRACT

A radio frequency aperture comprising a plurality of insulating layers disposed in a stack, each layer including an array of conductive regions, the conductive regions being spaced from adjacent conductive regions. Also disclosed is method of bending or steering radio frequency waves impinging an antenna. The method includes disposing a plurality of insulating layers arranged in a stack between a source of the radio frequency waves and the antenna, wherein each insulating layer includes an array of conductive regions, the conductive regions being spaced from adjacent conductive regions and forming capacitive elements. The capacitance of the capacitive elements in the plurality of insulating layers is adjusted as a function of their location in the plurality of insulating layers.

58 Claims, 5 Drawing Sheets

U.S. PATENT DOCUMENTS

| | | | | | |
|---|---|---|---|---|---|
| 5,287,118 | A | * | 2/1994 | Budd | 343/909 |
| 5,519,408 | A | | 5/1996 | Schnetzer | 343/767 |
| 5,525,954 | A | | 6/1996 | Komazaki et al. | 333/219 |
| 5,531,018 | A | | 7/1996 | Saia et al. | 29/622 |
| 5,534,877 | A | | 7/1996 | Sorbello et al. | 343/700 |
| 5,541,614 | A | | 7/1996 | Lam et al. | 343/792.5 |
| 5,557,291 | A | | 9/1996 | Chu et al. | 343/725 |
| 5,589,845 | A | | 12/1996 | Yandrofski et al. | 343/909 |
| 5,611,940 | A | | 3/1997 | Zettler | 73/514 |
| 5,638,946 | A | | 6/1997 | Zavracky | 200/181 |
| 5,694,134 | A | | 12/1997 | Barnes | 343/700 |
| 5,874,915 | A | | 2/1999 | Lee et al. | 342/375 |
| 5,894,288 | A | | 4/1999 | Lee et al. | 343/770 |
| 5,923,303 | A | | 7/1999 | Schwengler et al. | 343/853 |
| 5,945,951 | A | | 8/1999 | Monte et al. | 343/700 |
| 5,949,382 | A | | 9/1999 | Quan | 343/767 |
| 5,949,387 | A | * | 9/1999 | Wu et al. | 343/909 |
| 6,005,519 | A | | 12/1999 | Burns | 343/700 |
| 6,040,803 | A | | 3/2000 | Spall | 343/700 |
| 6,054,659 | A | | 4/2000 | Lee et al. | 200/181 |
| 6,075,485 | A | | 6/2000 | Lilly et al. | 343/700 |
| 6,081,235 | A | | 6/2000 | Romanofsky et al. | 343/700 |
| 6,097,263 | A | | 8/2000 | Mueller et al. | 333/17.1 |
| 6,097,343 | A | | 8/2000 | Goetz et al. | 343/708 |
| 6,118,406 | A | | 9/2000 | Josypenko | 343/700 |
| 6,127,908 | A | | 10/2000 | Bozler et al. | 333/246 |
| 6,154,176 | A | | 11/2000 | Fathy et al. | 343/700 |
| 6,166,705 | A | | 12/2000 | Mast et al. | 343/853 |
| 6,175,337 | B1 | | 1/2001 | Jasper, Jr. et al. | 343/770 |
| 6,191,724 | B1 | | 2/2001 | McEwan | 342/21 |
| 6,246,377 | B1 | | 6/2001 | Aiello et al. | 343/770 |

OTHER PUBLICATIONS

Doane, J.W., et al., "Field Controlled Light Scattering from Nematic Microdroplets", *Appl. Phys. Lett.*, vol. 48 (Jan. 1986) pp. 269–271.

Jensen, M.A. et al., "EM Interaction of Handset Antennas and a Human in Personal Communications", *Proceedings of the IEEE*, vol. 83, No. 1 (Jan. 1995) pp. 7–17.

Jensen, M.A., et al., "Performance Analysis of Antennas for Hand–held Transceivers using FDTD", *IEEE Transactions on Antennas and Propagation*, vol. 42, No. 8 (Aug. 1994) pp. 1106–1113.

Ramos, S., et al., *Fields and Waves in Communication Electronics*, 3rd Edition (New York, John WIley & Sons, 1994) Section 9.8 –9.11, pp. 476–487.

Sievenpiper, D., et. al., "High–Impedance Electromagnetic Surfaces with a Forbidden Frequency Band", *IEEE Transactions on Microwave Theory and Techniques*, vol. 47, No. 11, (Nov. 1999) pp. 2059–2074.

Sievenpiper, D., "High–Impedance Electromagnetic Surfaces", *Ph. D. Dissertion*, Dept. of Electrical Engineering, University of California, Los Angeles, CA, 1999.

Wu, S.T., et al., "High Birefringence and Wide Nematic Range Bis–tolane Liquid Crystals", *Appl. Phys. Lett.* vol. 74, No. 5, (Jan. 1999) pp. 344–346.

Ellis, T.J. and G.M. Rebeiz, "MM–Wave Tapered Slot Antennas on Micromachined Photonic Badgap Dielectrics," *1996 IEEE MTT–S International Microwave Symposium Digest*, vol. 2, pp. 1157–60 (1996).

Linardou, I., et al., "Twin Vivaldi antenna fed by coplanar waveguide," *Electronics Letters*, vol. 33, No. 22, pp. 1835–7 (Oct. 23, 1997).

Schaffner, J.H., et al., "Reconfigurable Aperture Antennas Using RF MEMS Switches for Multi–Octave Tunability and Beam Steering," *IEEE*, pp. 321–4 (2000).

Sievenpiper, D., et al., "Low–profile, four sector diversity antenna on high–impedance ground plane," *Electronics Letters*, vol. 36, No. 16, pp. 1343–5 (Aug. 3, 2000).

Sievenpiper, D. and Eli Yablonovitch, "Eliminating Surface Currents with Metallodielectric Photonic Crystals," *1998 IEEE MTT–S International Microwave Symposium Digest*, vol. 2, pp. 663–666 (Jun. 7, 1998).

* cited by examiner-

Figure 7 One possible way of reconfiguring the material is through a set of alignment pins, which could tilt the entire stack in various directions, and steer the transmitted beam.

RADIO FREQUENCY APERTURE

FIELD OF THE INVENTION

The present invention relates to a radio frequency aperture which may be placed in a RF beam for the purpose of steering the RF beam, focusing the rf beam and/or changing its polarization.

BACKGROUND OF THE INVENTION

The present invention relates to an antenna aperture and to the material to be used in an antenna aperture. This disclosed material is capable of performing various functions on a Radio Frequency (RF) beam passing through it by behaving as a tunable dielectric. The material includes a plurality of layers, each layer containing an array of small electrically conductive, preferably metallic, plates disposed therein. The plates in each layer preferably overlap with those of the neighboring layers, thereby forming capacitors. The lateral dimensions of the individual plates preferably measure much less than one wavelength of the frequency or frequencies of interest for the RF beam so that the material can be considered as an effective dielectric medium, with the conductive plates behaving as lumped capacitive circuit elements as opposed to behaving as radiating elements of an antenna.

Since each layer includes an array of plates and since the material includes a plurality of layers, a three-dimensional array of capacitors is provided which enhances the effective dielectric constant of the material. The dielectric effect is nonisotropic and depends on the density and arrangement of capacitors, so the dielectric tensor can be and preferably is, a function of location in the material. By moving, preferably by translational movements, each layer relative to its neighboring layers, the value of each capacitor, and thus the effective dielectric tensor, can be changed. In this manner, an arbitrary dielectric function can be obtained, and this dielectric function can be reprogrammed with only a small amount of movement of individual layers in a three dimensional array formed by a stack of layers.

This material can be effectively used as an antenna aperture where it can behave as a quasi-optical element. Having a programmable dielectric tensor allows it to perform a variety of operations in an antenna aperture. For example, it can be configured as a radio frequency tens or prism, to focus or steer a radio frequency beam, or as a quarter-wave plate, to convert a radio frequency beam between circular and linear polarization. Applications for such a material include tracking of one or more satellites and sending or receiving two polarizations of radio signals simultaneously from a single antenna installation.

The present invention also provides a method of steering an RF beam over a wide angle with only a small mechanical movement being required, if any is needed at all. Prior art approaches for RF beam steering generally involve using phase shifters or mechanical gimbals. With this invention, beam steering is accomplished by variable capacitors, thus eliminating expensive phase shifters and unreliable, bulky mechanical gimbals. The variable capacitors can be tuned with a relatively small differential mechanical motion, or alternatively, they can be tuned by electronic actuation. Furthermore, using this approach if the layers in the material are differentially moved in two orthogonal directions, then only two orthogonal controls are required to scan in two dimensions, eliminating the complexity of controlling many radiating elements independently. This invention does not depend on a particular feed method, and can be placed over an existing prior art antenna aperture of a dish antenna in order to add the functionality of beam steering to such a device. Furthermore, it can be used with receiving and/or transmitting antennas.

This invention also provides a method for converting between linear and circular polarization, which is important for satellite communications. It also allows two signals with opposite circular polarization to be steered independently, thus allowing the possibility of tracking two satellites simultaneously. In the prior art, this would be accomplished using two separate antennas.

The present invention allows a RF beam in the microwave frequencies, for example, to be manipulated in much the same way that visible light is manipulated by optical lens' and/or by quarter wave plates.

BRIEF DESCRIPTION OF THE INVENTION

Generally speaking the present invention provides a radio frequency aperture comprising a plurality of insulating layers disposed in a stack, each layer including an array of conductive regions, the conductive regions being spaced from adjacent conductive regions.

In another aspect the present invention provides method of bending or steering radio frequency waves impinging an on antenna. The method includes disposing a plurality of insulating layers arranged in a stack between a source of the radio frequency waves and the antenna, wherein each insulating layer includes an array of conductive regions, the conductive regions being spaced from adjacent conductive regions and forming capacitive elements; Also the capacitance of the capacitive elements in the plurality of insulating layers is adjusted as a function of their location in the plurality of insulating layers.

DETAILED DESCRIPTION

Figure 1:
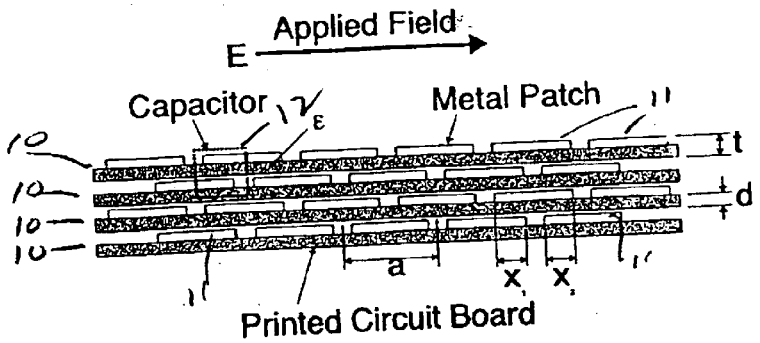
FIG. 1 is a side view of a stack of elements with conduction areas formed in an overlapping arrangement to define capacitors.

The antenna aperture of the present invention includes a stack of layers 10, with each layer 10 containing an array of conductive plates 11 attached to or embedded in a dielectric material 13. The plates 11 in each layer overlap the plates 11 in the adjacent layers, so that they form capacitors, one of which is depicted in the phantom line 5 forming box 12. According to the embodiment of this invention illustrated in FIG. 1, the individual layers are preferably formed using printed circuit boards and the plates 11 are preferably made of a metal such as copper conveniently etched using conventional printed circuit board fabrication processes. The dimensions of the plates and the thickness of the layers are much smaller than the wavelength of the frequency or frequencies of interest. The effective dielectric constant of the material depends not only on the dielectric constant of the printed circuit board material, but also on the number of capacitors per unit volume, their value, and their arrangement. For the geometry shown in FIG. 1, the effective dielectric constant along the horizontal direction is given by the following equation:

$$\varepsilon_{eff} = \frac{\varepsilon a x_1 x_2}{dt(x_1 + x_2)}$$

where:

$\in_{eff}$=dielectric constant between the capacitor plates;

a=period along the horizontal direction;

$x_1$=overlap distance with the left plate;

$x_2$ =overlap distance with the right plate;

d=thickness of the material between the capacitor plates; and t =overall thickness of each layer.

As can be seen by reference to the foregoing equation, the effective dielectric constant depends on the overlap of each plate 10 with each of its neighbors, which overlap is given by the values $x_1$ and $x_2$. By applying a lateral shift of one layer relative to an adjacent layer, the product $x_1$ $x_2$ changes, while the sum $(x_1+x_2)$ remains relatively constant. Thus, the effective dielectric constant depends on the lateral displacement of the layers. The array of plates 11 can have a different period, and a different displacement along the two orthogonal directions, so that the effective dielectric tensor will be non-isotropic, if desired. In effect, the material behaves as a biaxial optical crystal, but it operates on radio waves as opposed to visual light.

Figure 2:
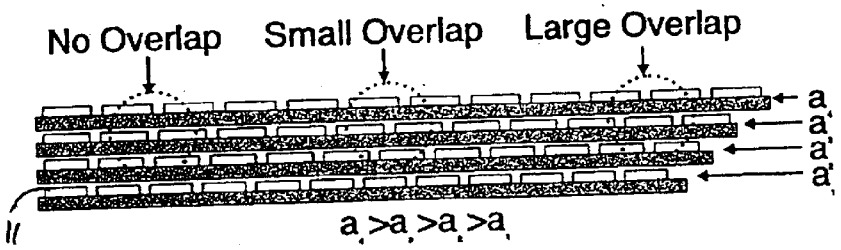
FIG. 2 is a stack similar to that of FIG. 1, but each layer has a slightly different lattice constant so that the over lap distance varies with position thereby imparting a gradient on the effect of dielectric constant.
Figure 3:
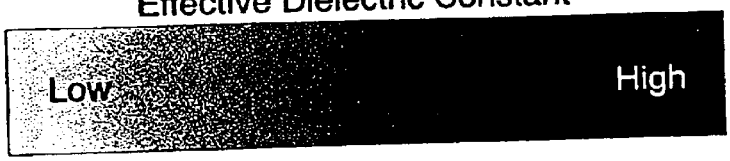
FIG. 3 depicts the dielectric constant as it changes for the device shown in FIG. 2.

By providing each layer with a different lattice constant, the overlap distance can vary as a function of position in the stack. This is illustrated in FIG. 2, in which the lattice constant of each layer is slightly larger than the layer above it. If the layers are aligned so that the overlap is larger on one side than the other, the effect is a graded dielectric constant along that particular direction. Additionally, the orthogonal direction to that shown in FIG. 2 may be provided with the same gradient, a different gradient, or no gradient at all. The effective dielectric constant is determined by the Moiré pattern which is formed between lattices having slightly different periods. This is illustrated by FIG. 3.

The layers 10 are preferably disposed immediately adjacent each other to minimize any air gaps (or other voids) which might otherwise occur between the layers 10. Such air gaps (or other voids) are normally undesirable since they would reduce the capacitive effect of the adjacent plates 11 in the layers 10.

Figures 4A, 4B:
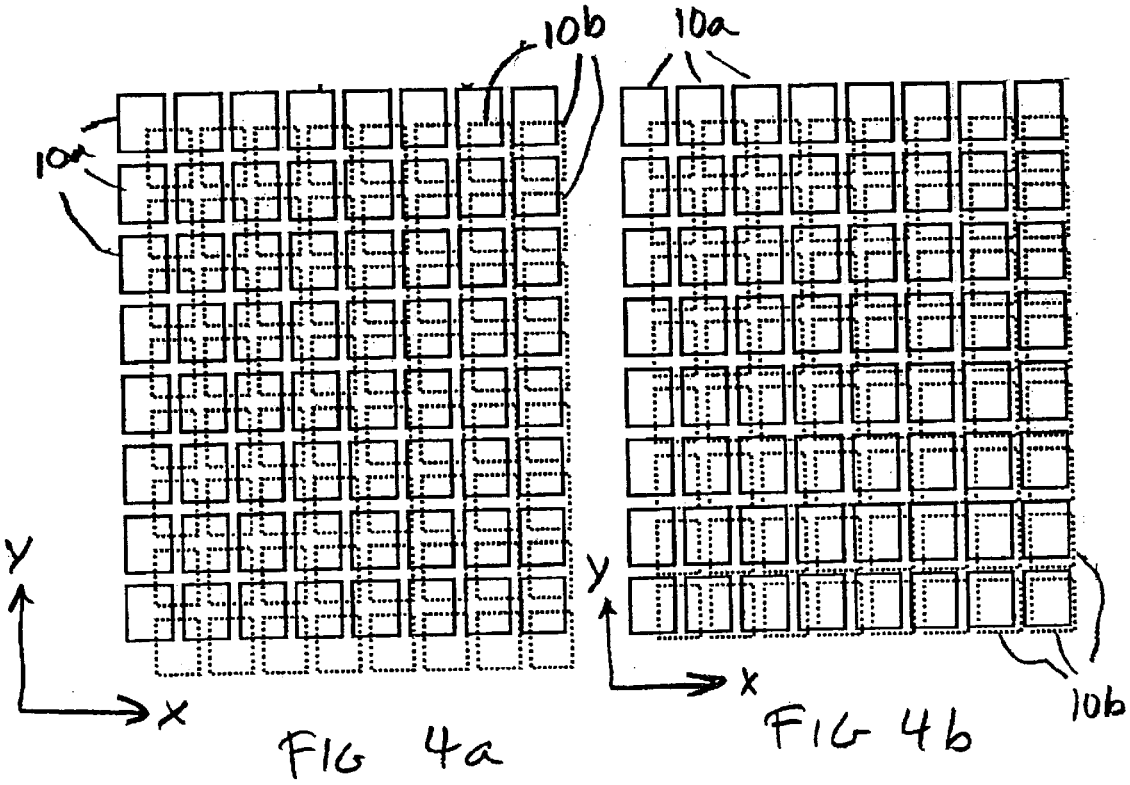
FIGS. 4*a* and 4*b* depict a stack of elements in plan view.

FIGS. 4*a* and 4*b* depict two adjacent layers 10 in a stack of layers with one layer 10*a* being shown in a solid line representation and the other layer 10*b* being shown in a dashed line representation. In FIG. 4*a* the capacitance gradient or tensor occurs in one direction only while in FIG. 4*b* the capacitance gradient occurs in two directions at the same time. Only two layers 10 are shown for ease of representation, it being understood that a stack would typically comprising a plurality of layers comprising more than two layers 10. But the relative shifts in the periodicity of the two adjacent layers 10*a* and 10*b* shown by FIGS. 4*a* and 4*b* can be easily repeated through a stack of layers.

In FIG. 4*a* the plates 11 of the capacitors in layers 10*a* and 10*b* share the same periodicity along the y-axis while the plates in these two layers have a slightly different periodicity along the x-axis. Since the plates 11 of the capacitors have the same overlap along the y-axis in FIG. 4*a*, there is no capacitive gradient in the y direction for the layers of FIG. 4*a*, while a capacitive gradient does occur along the x-axis due to the changing overlaps of the plates of the capacitors in that direction.

In FIG. 4*b*, the plates 11 of the capacitors in layers 10*a* and 10*b* have a different periodicity along both the x and y axes and hence the plates 11 of the capacitors have changing overlaps along both the x and y axes. As a result, the capacitive gradient changes along both the x and y axes for the configuration shown by FIG. 4*b*.

When an electromagnetic wave passes through a thin material with a graded dielectric constant $$\frac{\partial \varepsilon}{\partial x},$$

the beam is bent according to the following equation:

$$\Theta = T\frac{\partial \varepsilon}{\partial x}$$

where

T=thickness of the graded dielectric layer; and

θ=angle in radians.

Figure 5:
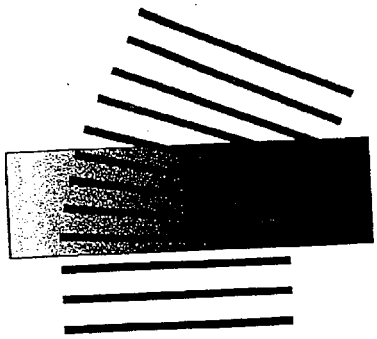
FIG. 5 shows an application of the device in which a beam passing through it is steered when the device acts as a graded index prism.

The previously described structures can mimic a graded index prism which can be turned in any direction, or have any desired slope, determined by making a small shift of the layers 10. This property can be used to steer a beam passing through the material, as shown in FIG. 5. The angle of the beam is determined by the angle and magnitude of the shift which is applied to the layers.

Figure 6:
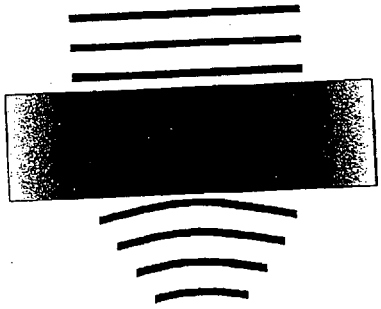
FIG. 6 shows an application of the device to focus it being passed into it by acting as a graded index lens.

By arranging the structure so that the dielectric constant or capacitance is highest in the middle, it can focus beam as is shown in FIG. 6. In practice, both of these functions would normally be used together or combined into a single unit, which would both collimate radiation from a source, and aim the collimated beam in a desired direction.

The dielectric constant or capacitance of the layers is shown shifting in one direction only in FIGS. 5 and 6, but as can be seen from FIG. 4*b*, the capacitive or dielectric gradient change in two directions at the same time, so the focussing shown in FIG. 6 can occur in only one direction or in two directions as a matter of design choice.

Figure 7A:
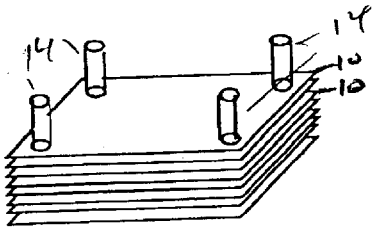
FIGS. 7*a* and 7*b* show the plates of FIGS. 1 and 2 positionaly controlled by pins.
Figure 7B:
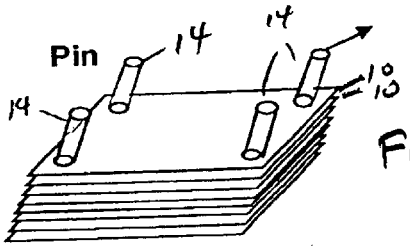
Figure 8A:
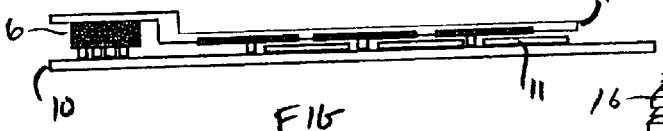
FIGS. 8*a* and 8*b* show another technique for moving the plates relative to each other by the use of piezoelectric actuators.
Figure 8B:
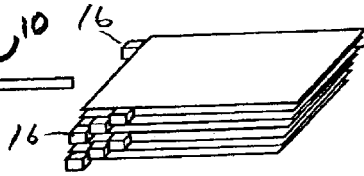

A technique for steering a RF beam is shown in FIGS. 7*a* and 7*b* show in which a set of pins 14 are used to tilt the stack of plates in various directions. Since only a small mechanical motion is required to steer the beam over a large angle, this embodiment of the aperture would be effective for applications, such as tracking satellites, which move across the sky with a time scale in terms of minutes. Another possible method for moving the layers is to use piezoelectric actuators 16 as shown in FIGS. 8*a* and 8*b*. This type of actuator uses friction, and the small, repetitive motion of a piezoelectric transducer to produce a large motion in a step-like manner. As suitable piezoelectric actuator is presently available as a commercial product from MicroPulse Systems of Santa Barbara, Calif.

The structures depicted by FIGS. 7, 8*a* and 8*b* are effective to impart a relative rectilinear movement to the layers 10 in a stack of layers along the x and y axes. Since the plates 11 are are depicted as being rectangular in FIGS. 4*a* and 4*b*, such x and y axis rectilinear movement is consistent since it certainly makes it easier to predict how the capacitive or dielectric gradient will change in response to such movement. However, the plates 11 do not need to be associated with any particular coordinate system and the relative movement between plates does not need to be associated with any particular coordinate system, but the x and y coordinate system is preferred for arranging the plates 11 and rectilinear movement is similarly preferred for the relative movement between layers 10.

If the lattice of conductive plates 11 is anisotropic, the effective dielectric constant depends on the direction of the applied electric field, as in a birefringent optical crystal. As such, the disclosed device can be used to mimic devices such as a quarter-wave plate, which are used to convert between linear and circular polarization. A quarter-wave plate is a slab of material in which the optical thickness differs by one-quarter wavelength in each linear polarization. If the gaps between the metal plates are small, and the plates are thin compared to the dielectric space between them, the necessary geometry for a quarter-wave plate is determined by the equation below:

$$|a-b|\sqrt{\varepsilon} = \frac{\lambda}{2}\cdot\frac{t}{T}$$

where a=lattice constant in X-direction;

b=lattice constant in Y-direction;

$\in$=background dielectric constant;

$\lambda$=wavelength;

t=thickness of each layer; and

T=overall thickness.

Figure 9:
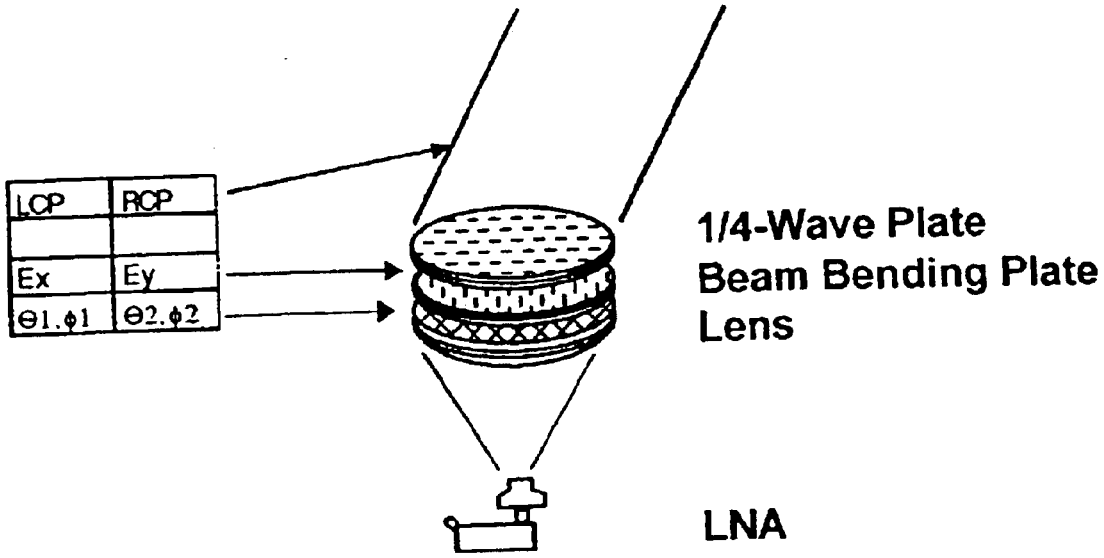
FIG. 9 shows an antenna aperture consisting of a quarter-wave plate, a beam bending plate, and a lens which may be combined into a single unit when used to steer incoming transmissions from a satellite to a LNA (Low Noise Amplifier) of the type typically associated with a dish antenna.

Such a device can be used to receive signals from two satellites with opposite polarization, for example, and convert them into two orthogonal linear polarization. These may be bent in two different directions using the beam-bending plate shown in FIG. 3 and FIG. 4. For focusing, a lens function may be added by using either the focusing feature shown in FIG. 5, or by using a shaped set of high dielectric layers with surfaces following classical geometrical optics designs (accounting for the tensor form of the dielectric constant.) The entire structure would be stacked to form a single unit, as shown in FIG. 9 this would allow independent tracking of two different satellites with a single antenna, with the two signals distinguished by their polarizations.

The methods described herein lead to a low cost method of constructing materials, known historically as biaxial crystals, and for changing their dielectric tensor in order to achieve independent control of $\in_{xx}$, $\in_{yy}$, $\in_{zz}$. Such non-uniform crystals exhibit many useful and diverse properties found in a host of commercial optical devices. However, by virtue of this invention, the dielectric tensor that distinguishes one type of crystal from another can now be altered at will and utilized in the microwave and millimeter wave bands.

The uses of the material disclosed herein extends beyond the quasi-optical components shown above in the foregoing figures. For example, the structure can be used to mimic any structure which is defined by an effective dielectric constant, such as prisms, gratings, waveguides and the like.

The structure depicted in FIG. 1, has been simulated by a lattice of 2 mm square metal plates 11 on printed circuit boards, the plates 11 being separated from each other by 0.1 mm in both the lateral and vertical directions. Thin printed circuit boards having a thickness of only 0.1 mm are readily available For example, polymide printed circuit boards are commercially available as thin as 1 mil (0.025 mm) and therefor the disclosed structure with printed circuit board technology can be used in very hugh frequency applications, if desired. The simulated stack contained 24 individual layers, each initially offset from their neighbors by ½ lattice period. Plane waves were transmitted through the structure, and the phase was observed as the individual layers were moved.

Figure 10:
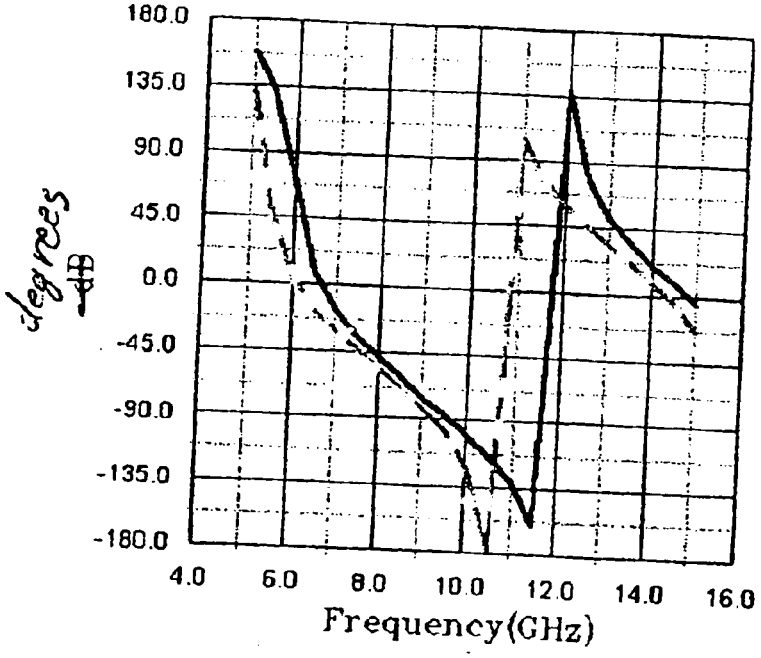
FIG. 10 shows the transmission phase through an embodiment of the structure shown in FIG. 1.

FIG. 10 shows the transmission phase through this structure, indicated by the solid line curve. It also shows the transmission phase through another structure in which every other layer was translated vertically, in the direction normal to the plates, by 0.05 mm. This altered structure is indicated by the broken line curve. Half the capacitors increased in value, and half decreased in value. The net result was an increase in the effective dielectric constant, indicating that these capacitors appear in parallel with each other. This is indicated by the fact that the phase has shifted downward. If this phase shift depends on the position in the stack, then this structure can perform the previously discussed functions.

Figure 11:
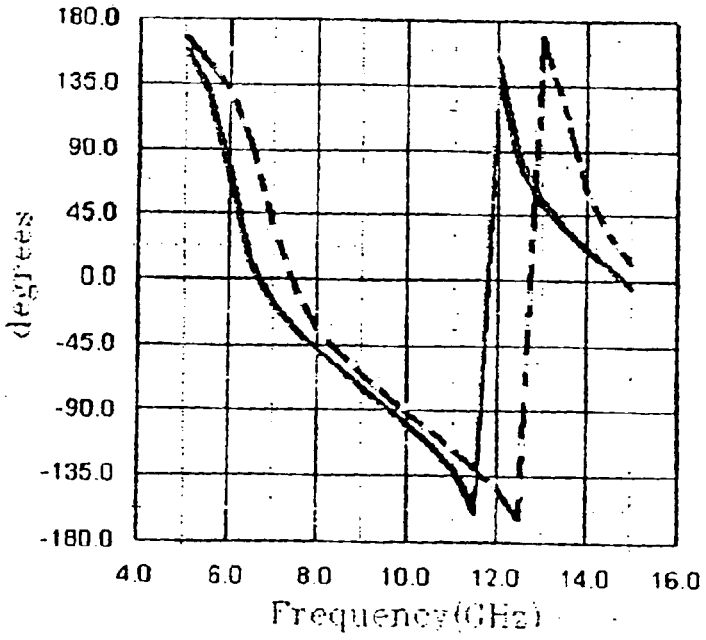
FIG. 11 shows the transmission phase through another embodiment.

FIG. 11 shows the transmission phase through a structure in which every other layer is translated laterally by 0.5 mm. The solid line curve is for the initial structure, but the solid line curve also corresponds to a structure in which the translation is in the direction of the applied RF magnetic field. The overlap of these curves for these cases indicates that the lateral translation has no effect in this direction. The broken line curve is for a structure in which the translation is in the direction of the applied RF electric field. Note the decrease in the effective dielectric constant, which is observed as a phase shift. Also, note the polarization dependence of this effect, shown in by the difference between the broken and solid curves. This characteristic allows for the production of such devices as a microwave quarter-wave-plate.

Having described the invention with respect to preferred embodiments thereof, modification will now doubtlessly suggest itself to those skilled in the art. For example, while the layers 10 previously described herein are all of a planar configuration, there is no theoretical reason for limiting the invention to planar layers 10. Indeed, the layers could each assume a cylindrical or spherical configuration, for example, with each layer having a slightly different radius so that the can move relative to each other and at the same time be disposed adjacent each other. However, planar layers 10 are preferred since their use simplifies the construction of the disclosed structure. Additionally, while the preferred movement between adjacent layers 10 is rectilinear, any other relative motion could be utilized which realizes a change in capacitance to thereby effect a beam passing through the structure. In addition, the boards on which the plates of the capacitors are disposed can become quite thin depending on the choices made by the designer. If very thin plates are utilized, in order to keep them planar (or cylindrical, for that matter) they might well be used with other structures in order to help maintain their shape. For example, the layers 10 disclosed herein could certainly be used with one or more sheets of material transparent to the frequencies of interest, such as glass or acrylic sheets, to support the layers 10. As such, the invention is not to be limited to the embodiments described above except as required by the appended claims

What is claimed is:

1. A radio frequency aperture comprising a plurality of insulating layers disposed in a stack, each layer including an array of discrete conductive regions, the discrete conductive regions being spaced from adjacent discrete conductive regions and wherein neighboring layers have a slightly different periodicity in at least in one direction so that the effective dielectric constant of the radio frequency aperture varies along said at least one direction.

2. The radio frequency aperture of claim 1, wherein said layers are disposed in the stack immediately adjacent to one another.

3. The radio frequency aperture of claim 1, wherein said insulating layers are printed circuit boards.

4. The radio frequency aperture of claim 1, wherein said insulating layers are formed of polyamide.

5. The radio frequency aperture of claim 1, wherein said conductive regions are rectangularly shaped.

6. A radio frequency lens for bending a radio frequency wave passing through the lends, said lens comprising a plurality of insulating layers disposed in a stack, each layer including an array of discrete conductive regions, the discrete conductive regions being spaced from adjacent discrete conductive regions and wherein neighboring layers have slightly different periodicity in only one direction and have a uniform periodicity in a direction orthogonal thereto.

7. A radio frequency aperture comprising a plurality of insulating layers disposed in a stack, each layer including an array of discrete conductive regions, the discrete conductive regions being spaced from adjacent discrete conductive regions and wherein neighboring layers have slightly different periodicity in two major axes of the layers.

8. A radio frequency aperture comprising a plurality of insulating layers disposed in a stack, each layer including an array of discrete conductive regions, the discrete conductive regions being spaced from adjacent discrete conductive regions, wherein neighboring layers have different periodicities in at least two directions so that the effective dielectric constant of the radio frequency aperture varies along said at least two directions as a function of location in said layers.

9. The radio frequency aperture of claim 8, wherein the layers are planar, the layers disposed in the stack are relatively moveable with respect to one another and wherein the movement between adjacent layers is rectilinear in a direction parallel to the planes of said layers.

10. The radio frequency aperture of claim 8, wherein the layers are planar, the layers disposed in the stack are relatively moveable with respect to one another and wherein the movement between adjacent layers is normal in a direction parallel to the planes of said layers.

11. The radio frequency aperture of claim 8, further including means for moving at least one layer relative to another layer.

12. A method of bending or steering radio frequency waves impinging an antenna, the method comprising:

disposing a plurality of insulating layers arranged in a stack between a source of the radio frequency waves and the antenna, wherein each insulating layer includes an array of conductive regions, the conductive regions being spaced from adjacent conductive regions and forming capacitive elements; and adjusting the capacitance of the capacitive elements in the plurality of insulating layers as a function of their location in the plurality of insulating layers.

13. The method of claim 12 wherein the step of adjusting the capacitance of the capacitive elements is performed by moving the insulating layers relative to each other.

14. The method of claim 13 wherein said conductive regions have rectangular configurations and wherein the movement of the insulating layer is rectilinear.

15. The method of claim 14, wherein the insulating layers are planar.

16. The method of claim 12 wherein the step of adjusting the capacitance of the capacitive elements in the plurality of insulating layers is performed by adjusting a periodicity of the conductive regions relative to at least two adjacent layers along at least one direction in said layers.

17. The method of claim 16 wherein the periodicity is adjusted in two directions in said layers.

18. The method of claim 12 wherein the radio frequency waves are focussed by the method, the capacitive elements providing a high capacitance in a center portion of each layer compared to peripheral portions of each layer.

19. A radio frequency lens for bending a radio frequency wave passing through the lends, the lens comprising a plurality of insulating layers disposed in a stack, each layer including an array of discrete conductive regions, the discrete conductive regions being spaced from adjacent discrete conductive regions and wherein neighboring layers have a slightly different periodicity in at least in one direction so that the effective dielectric constant of the radio frequency aperture varies along said at least one direction.

20. The radio frequency lens of claim 19, wherein neighboring layers have slightly different periodicity in only one direction and have a uniform periodicity in a direction orthogonal thereto.

21. The radio frequency lens of claim 19, wherein neighboring layers have slightly different periodicity in two major axes of the layers.

22. The radio frequency lens of claim 19, wherein said layers are disposed in the stack relatively moveable with respect to one another.

23. The radio frequency lens of claim 19, wherein the layers are planar and wherein the movement between adjacent layers is rectilinear in a direction parallel to the planes of said layers.

24. The radio frequency lens of claim 22, wherein the layers are planar and wherein the movement between adjacent layers is normal in a direction parallel to the planes of said layers.

25. The radio frequency lens of claim 22, further including means for moving at least one layer relative to another layer.

26. The radio frequency lens of claim 19, wherein said layers are disposed in the stack immediately adjacent to one another.

27. The radio frequency lens of claim 19, wherein said insulating layers are printed circuit boards.

28. The radio frequency lens of claim 19, wherein said insulating layers are formed of polymide.

29. The radio frequency lens of claim 19, wherein said conductive regions are rectangularly shaped.

30. A radio frequency aperture comprising a plurality of insulating layers disposed in a stack, each layer including an array of conductive regions, the conductive regions being spaced from adjacent conductive regions, wherein neighboring layers have a different periodicity in at least one direction so that the effective dielectric constant of the radio frequency aperture varies along said at least one direction and wherein the layers disposed in the stack are relatively moveable with respect to one another.

31. The radio frequency aperture of claim 30, wherein neighboring layers have slightly different periodicity in only one direction and have a uniform periodicity in a direction orthogonal thereto.

32. The radio frequency aperture of claim 30, wherein neighboring layers have slightly different periodicity in two major axes of the layers.

33. The radio frequency aperture of claim 30, wherein the layers are planar and wherein the movement between adjacent layers is rectilinear in a direction parallel to the planes of said layers.

34. The radio frequency aperture of claim 30, wherein the layers are planar and wherein the movement between adjacent layers is normal in a direction parallel to the planes of said layers.

35. The radio frequency aperture of claim 30, further including means for moving at least one layer relative to another layer.

36. The radio frequency aperture of claim 30, wherein said layers are disposed in the stack immediately adjacent to one another.

37. The radio frequency aperture of claim 30, wherein said insulating layers are printed circuit boards.

38. The radio frequency aperture of claim 30, wherein said insulating layers are formed of polyamide.

39. The radio frequency aperture of claim 30, wherein said conductive regions are rectangularly shaped.

40. A radio frequency aperture for steering a radio frequency beam passing therethrough, the aperture comprising a plurality of insulating layers disposed in a stack, each layer including a two dimensional array of conductive regions, the conductive regions being isolated from adjacent conductive regions and wherein said layers disposed in the stack are relatively moveable with respect to one another to steer said radio frequency beam.

41. The radio frequency aperture of claim 40, wherein neighboring layers have a slightly different periodicity in at least in one direction so that the effective dielectric constant of the radio frequency aperture varies along said at least one direction.

42. The radio frequency aperture of claim 40, wherein neighboring layers have slightly different periodicity in only one direction and have a uniform periodicity in a direction orthogonal thereto.

43. The radio frequency aperture of claim 40, wherein neighboring layers have slightly different periodicity in two major axes of the layers.

44. The radio frequency aperture of claim 40, wherein the layers are planar and wherein the movement between adjacent layers is rectilinear in a direction parallel to the planes of said layers.

45. The radio frequency aperture of claim 40, wherein the layers are planar and wherein the movement between adjacent layers is normal in a direction parallel to the planes of said layers.

46. The radio frequency aperture of claim 40, further including means for moving at least one layer relative to another layer.

47. The radio frequency aperture of claim 40, wherein said layers are disposed in the stack immediately adjacent to one another.

48. The radio frequency aperture of claim 40, wherein said insulating layers are printed circuit boards.

49. The radio frequency aperture of claim 40, wherein said insulating layers are formed of polyamide.

50. The radio frequency aperture of claim 40, wherein said conductive regions are rectangularly shaped.

51. A method of bending or steering radio frequency waves impinging an antenna, the method comprising:

disposing a plurality of insulating layers arranged in a stack between a source of the radio frequency waves and the antenna, wherein each insulating layer includes a two dimensional array of conductive regions, the conductive regions being isolated from adjacent conductive regions and forming capacitive elements; and adjusting the capacitance of the capacitive elements in the plurality of insulating layers as a function of their location in the plurality of insulating layers.

52. The method of claim 51 wherein the step of adjusting the capacitance of the capacitive elements is performed by moving the insulating layers relative to each other.

53. The method of claim 52 wherein said conductive regions have rectangular configurations and wherein the movement of the insulating layer is rectilinear.

54. The method of claim 53 wherein the insulating layers are planar.

55. The method of claim 51 wherein the step of adjusting the capacitance of the capacitive elements in the plurality of insulating layers is performed by adjusting a periodicity of the conductive regions relative to at least two adjacent layers along at least one direction in said layers.

56. The method of claim 55 wherein the periodicity is adjusted in two directions in said layers.

57. The method of claim 51 wherein the radio frequency waves are focussed by the method, the capacitive elements providing a high capacitance in a center portion of each layer compared to peripheral portions of each layer.

58. A radio frequency aperture comprising a plurality of insulating layers disposed in a stack, each layer including an array of discrete conductive regions, the discrete conductive regions being spaced from adjacent discrete conductive regions and where capacitive couplings between the discrete conductive regions of one layer and the discrete conductive regions of an adjacent layer are variable in response to translational movement of the layers.

* * * * *